US005727398A

United States Patent [19]

Phillippe

[11] Patent Number: 5,727,398

[45] Date of Patent: Mar. 17, 1998

[54] REFRIGERANT AGITATION APPARATUS

[76] Inventor: Gary E. Phillippe, 7263 Larchmont Dr., North Highlands, Calif. 95660

[21] Appl. No.: 686,016

[22] Filed: Jul. 25, 1996

[51] Int. Cl.[6] ..... F25B 43/00; B01F 5/00

[52] U.S. Cl. ..... 62/503; 138/40

[58] Field of Search ..... 62/468, 503, 511, 62/527, 502; 165/109.1, DIG. 529, DIG. 530; 138/38, 39, 40, 44

[56] References Cited

U.S. PATENT DOCUMENTS

| | | | |
|---|---|---|---|
| 1,605,401 | 11/1926 | Hamilton | 138/40 |
| 2,268,386 | 12/1941 | Fisher | 165/109.1 |
| 3,736,961 | 6/1973 | Walsh | 138/38 |
| 3,964,875 | 6/1976 | Chang et al. | 138/40 |
| 4,229,949 | 10/1980 | Brandin | 62/503 |
| 4,776,183 | 10/1988 | Okoma | 62/503 |
| 4,929,088 | 5/1990 | Smith | 138/40 |
| 5,426,956 | 6/1995 | Phillippe | 62/509 |

*Primary Examiner*—William Doerrler
*Attorney, Agent, or Firm*—James M. Ritchey

[57] ABSTRACT

A turbulent flow generating apparatus for use with a refrigerant containing heat exchange system that has a refrigerant carrying line includes at least one housing fitted into the refrigerant carrying line and within each housing a refrigerant agitating mechanism comprising and at least one bladed disk that induces refrigerant agitation as the refrigerant flows through the subject apparatus.

17 Claims, 3 Drawing Sheets

REFRIGERANT AGITATION APPARATUS

BACKGROUND OF THE INVENTION

1. Field of the Invention

For efficiency amplification, means for increasing mixing of a refrigerant through rotational agitation is disclosed. More specifically, by relying on principles of fluid mechanics and turbulent flow of a refrigerant, the subject apparatus, when placed in a refrigerant line, mixes the refrigerant and decreases pooled lubricants inside the refrigerant line. The refrigerant mixing increasing the homogeneity of blended refrigerants and the effective volume of the refrigerant.

2. Description of the Background Art

Various devices relying on standard refrigerant recycling technologies have been available for many years. Refrigeration and heat pump devices, having both cooling and heating capabilities, are included within the general scheme of the subject invention. Within the limits of each associated design specification, heat pump devices enable a user to cool or heat a selected environment or with a refrigeration unit to cool a desired location. For these heating and cooling duties, in general, gases or liquids known as "refrigerants" are compressed, expanded, heated, or cooled within an essentially closed system to produce a desired temperature result in the selected environment.

Due to possible and real damage to the environment, previously pure refrigerants have been replaced with blends of materials. Some blended refrigerants tend to separate upon standing and in the separated state function less well for their intended purpose as a refrigerant.

Equipment that uses recirculating refrigerants usually employ a mechanical pumping system that utilizes lubricants such as oil and the like to minimize friction and to seal moving parts during operation. Unfortunately, the lubricant often bleeds into the refrigerant and spreads into the lines carrying the refrigerant. Contaminating lubricants do not function as refrigerants in heat exchange processes and decrease the efficiency of the system. In traditional refrigerant lines the lubricant tends to pool in the low points along the lines, thereby decreasing the total available refrigerant for heat exchange usage.

U.S. Pat. No. : 5,426,956 issued to the subject inventor employs a large vessel with a device that spins the exiting refrigerant to produce turbulent motion in the refrigerant. The turbulent refrigerant travels at a higher velocity than normal laminar type flow in a refrigerant line. Thus, with the adaptation of a fixed pressure heat pump system by the '956 device, the capacity of the compressor is maintained due to increased refrigerant velocity, volume, and refrigerant Btu capacity because of lower condensing temperature and an introduced spiral turbulent flow, rather than a straight laminar flow. With the '956 adapted system, the hotter the condensing temperature and the higher the load, the better the adapted system functions.

SUMMARY OF THE INVENTION

Disclosed for use with a heat exchange system is a turbulent flow generating apparatus for use with a refrigerant containing heat exchange system having a refrigerant carrying line. The device comprises a housing fitted into the refrigerant carrying line that comprises a first housing half that comprises first cylindrical member having a first region that expands into a larger diameter second region and a second housing half that comprises a second cylindrical member having a first region that tapers into a narrower diameter second region. The first cylindrical member second region fits within the second cylindrical member first region. Also provided is a means within the housing for agitating the refrigerant to produce turbulent motion in the refrigerant. The agitation means comprises a first disk having a first perimeter rim with a first central orifice and at least two first blades projecting from the first perimeter rim into the first central orifice. Preferably, included is a second disk that comprises a second perimeter rim with a second central orifice and at least two second blades projecting from the second perimeter rim into the second central orifice.

Usually, the first and the second disks fit within the second cylindrical member first region and proximate the first cylindrical member second region. This interaction secures the first and the second disks within the housing.

Generally, each of the first and the second disks have a plurality of blades, wherein when fitted within the second cylindrical member first region, the plurality of blades are aligned to generate regular spacings between the blades on both the first and the second disks.

The subject apparatus is utilized by placing one or more of the subject units (turbulent flow generating apparatus) within the refrigerant line at spacing intervals that maximize efficiency within the system by mixing and blending the refrigerant at suitable locations within the refrigerant line.

Other objects, advantages, and novel features of the present invention will become apparent from the detailed description that follows, when considered in conjunction with the associated drawings.

DESCRIPTION OF THE PREFERRED EMBODIMENT

Before a detailed description of the subject invention is presented, a rationale for the subject systems amplification of efficiency is presented. As indicated above, frequently, previously pure refrigerants have been replaced with blends of materials. Some blended refrigerants tend to separate upon standing and in the separated state function less well for their intended purpose as a refrigerant. Additionally, equipment that uses recirculating refrigerants usually employ a mechanical pumping system that utilizes lubricants such as oil and the lubricant often bleeds into the refrigerant and spreads into the lines carrying the refrigerant. The contaminating lubricants do not function as refrigerants in heat exchange processes and decrease the efficiency of the system and tend to pool in the low points along the lines, thereby decreasing the total available refrigerant for heat exchange usage. The subject invention produces turbulent flow within the refrigerant carrying lines, thereby mixing the lubricants with the refrigerant and blending components of the refrigerant into a more homogeneous form that has the intended and expected efficiency characteristics.

Figure 1:
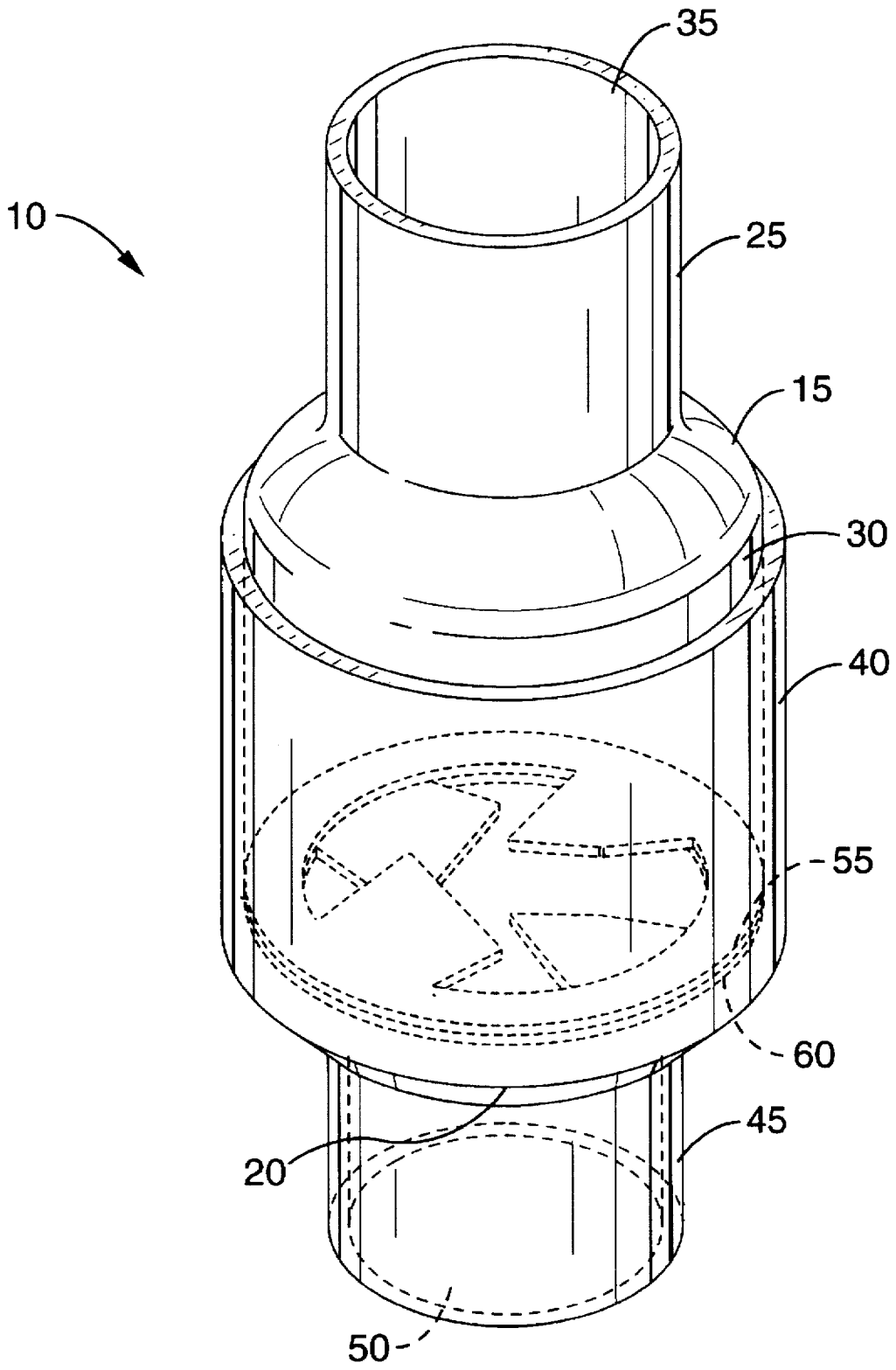
FIG. 1 is a perspective view of the subject invention.
Figure 2:
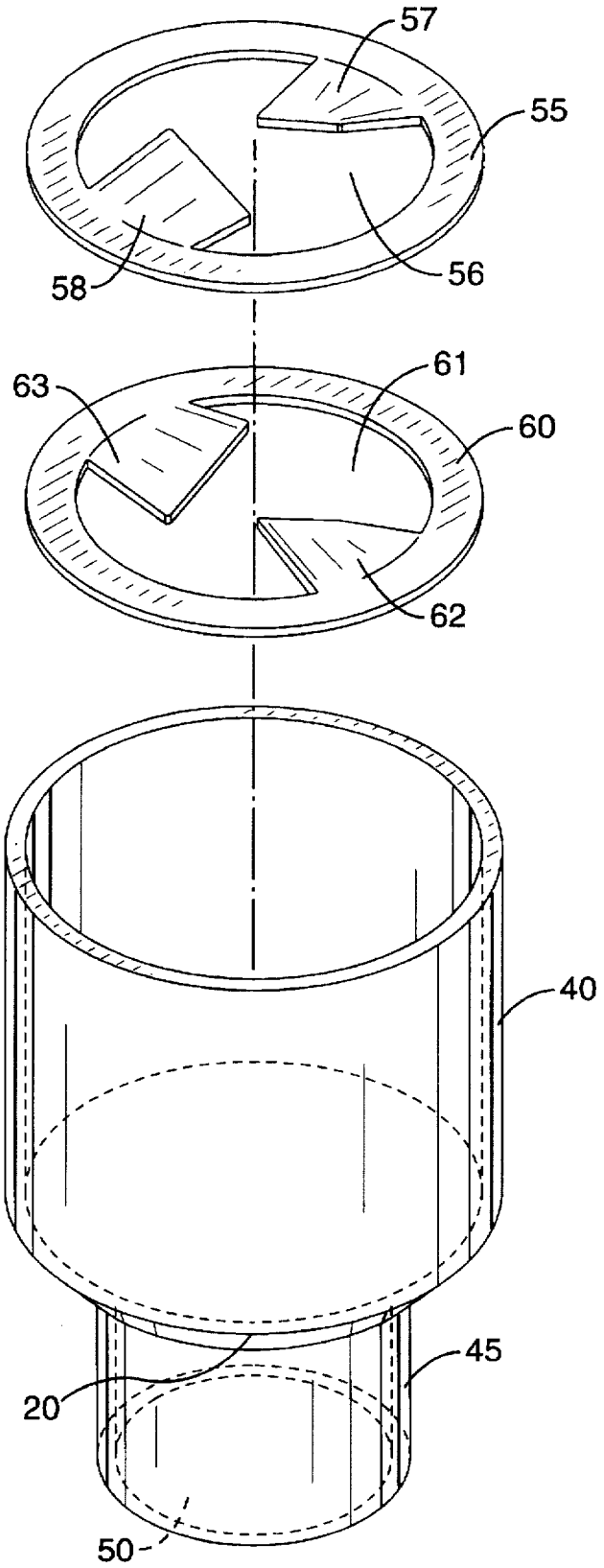
FIG. 2 is an exploded view of a portion of the subject invention.

Referring now to FIG. 1, there is shown a preferred embodiment of the subject turbulent flow generation apparatus 10. Preferably, comprising the device is a housing that has two halves 15 and 20 that mate with one another to produce the complete housing. Each half 15 and 20 of the housing are generally cylindrical in form. The housing halves 15 and 20 are fabricated from suitable materials such as copper, copper alloys, equivalent metals, natural and synthetic polymers and the like. Usually, the housing halves 15 and 20 are made from the same or similar material as the refrigerant line into which they will be placed.

As seen in FIG. 1, the first housing half 15 comprises a first cylindrical region 25 that expands into a second cylindrical region 30. The first cylindrical region 25 has an interior aperture 35 for receiving the refrigerant carrying line. Usually, the aperture 35 accepts the line and is secured in place by suitable means such as soldering with appropriate flux and solder.

The second housing half 20 comprises a first cylindrical region 40 that tapers into a second cylindrical region 45. The second cylindrical region 45 has an interior aperture 50 for receiving the refrigerant carrying line to complete the insertion of the subject apparatus into the refrigeration system. As with the first housing half 15 and the line connecting aperture 35, the second housing half aperture 50 accepts the line and is secured in place by like suitable means such as soldering with appropriate flux and solder.

As is evident in FIG. 1, the outside diameter of the first housing half second region 30 is slightly smaller than the inner diameter of the second housing half first region 40. The slightly smaller diameter of the second region 30 permits the telescopic mating of the two halves 15 and 20 to form the complete housing. Although second region 30 slips within first region 40 in the preferred embodiment, other equivalent connection schemes are contemplated to be within the realm of this disclosure, including threaded arrangements, bayonet couplings, and the like. Generally, the mated housing halves 15 and 20 are secured together by suitable means such as soldering, brazing, welding, gluing, and the like.

Within the housing is means for agitating the refrigerant to produce turbulent motion in the refrigerant as the refrigerant is pumped through the subject apparatus. Preferably, the agitation means comprises one or more disks, with each disk having at least one blade that agitates the refrigerant during refrigerant flow through the subject device. Specifically, as depicted in FIGS. 1–4, two disks 55 and 60 fit within the second housing 20 and into the first cylindrical region 40. The diameters of the disks 55 and 60 are selected to permit each disk 55 and 60 to fit snugly within the first cylindrical region's 40 interior space. The disks 55 and 60 set on the interior tapered sides of the second housing half 20. When the first housing half 15 is inserted into the second housing half, the disks 55 and 60 are fixed and held in position. It must be stressed that a single disk with four blades is essentially equivalent to the depicted two disk version shown in FIGS. 1–4. Due to fabrication considerations concerning the forming of the angled blades, a disk with only two blades is easier to make than a disk with additional blades. Therefore, two disks with two blades each is easier to produce than a single disk with three or more blades. However, as noted, a single disk that contains a suitable number of blades is considered to be disclosed by the subject description.

Each disk has a central orifice 56 and 61 surrounded by a perimeter rim. Blades formed in each disk project from the perimeter rim and into the central orifice, specifically, for disk 55 blades 57 and 58 and for disk 60 blades 62 and 63. The figures depict two blades on each disk, but one, three, or more blades may be formed or attached to any disk. The blades 57, 58, 62, and 63 are all bent out of the plane that holds the remainder of the disk. The angle of the bend may be varied, but is generally between about 20° and about 80° and more commonly between about 40° and 70°. The angled blades create a type of "artificial fluting" and spin (create rotational motion) the passing refrigerant, much like a barrel of a rifle with spiral fluting the spins an exiting bullet. The spinning refrigerant moves in a turbulent flow, thereby mixing the refrigerant with contaminating lubricants and blending possibly separating components of the refrigerant into a more homogeneous material.

Figure 3:
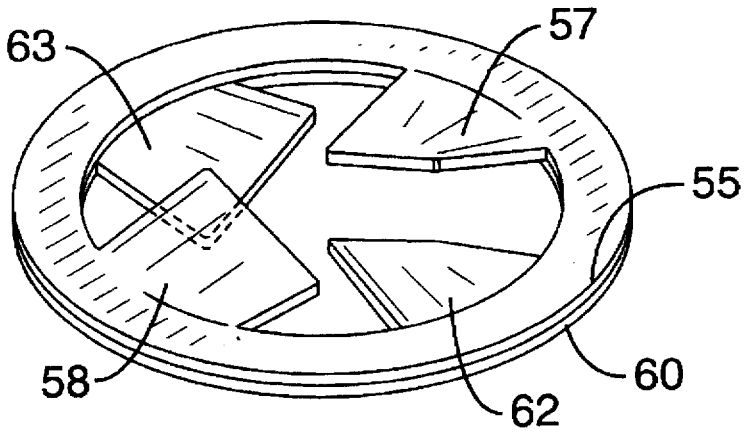
FIG. 3 is a perspective view of a turbulent flow generating disk.
Figure 4:
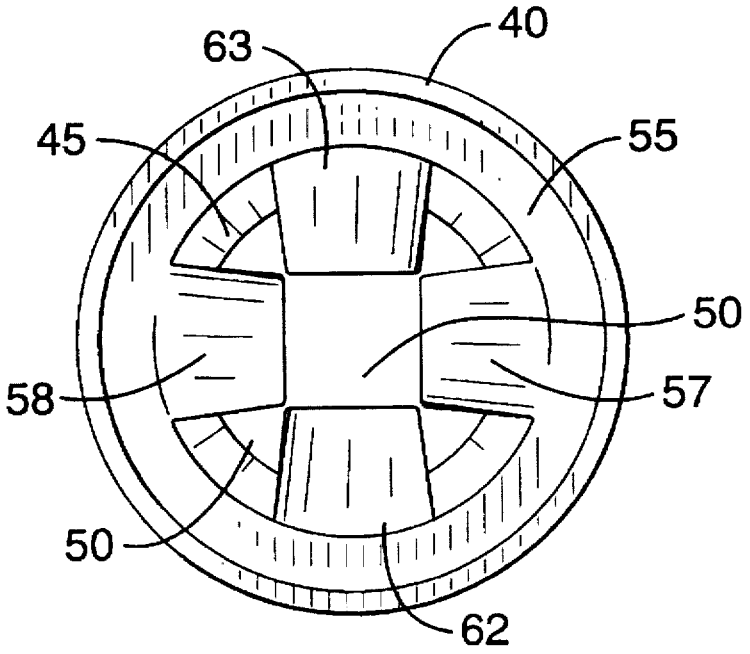
FIG. 4 is a plan view of two turbulent flow generating disks fitted within one half of the subject housing.

FIG. 3 illustrates the usual alignment of two disks 55 and 60. Preferably, the blades are aligned to produce regular spacings between the blades when viewed along an axis running the length of the housing. The common evenly spaced blades 57, 58, 62, and 63 are seen along the axis running the length of the housing in FIG. 4. Even though even spacings are preferred, uneven blade spacings are considered within the purview of this disclosure. In general, any spacial arrangement of the blades that creates a turbine effect in the flowing refrigerant is acceptable.

The subject turbulent flow generating apparatus (subject unit) is utilized in newly assembled refrigeration systems or in retrofitting existing systems. For either situation, one or more of the subject units are inserted into the refrigerant line. When more that one subject unit is employed in a refrigerant line, the spacing is selected to maximize efficiency and cost.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. A turbulent flow generating apparatus for use with a refrigerant containing heat exchange system having a liquid refrigerant carrying line, comprising:

a) a housing fitted into the liquid refrigerant carrying line, wherein said housing comprises:

i) a first cylindrical member having a first region that expands into a larger diameter second region and ii) a second cylindrical member having a first region that tapers into a narrower diameter second region, wherein said first cylindrical member second region fits within said second cylindrical member first region and b) means within said housing for agitating the refrigerant to produce turbulent motion in the refrigerant, wherein said agitation means comprises blades secured within said housing, wherein said blades induce rotational motion in the refrigerant as the refrigerant travels past said blades.

2. A turbulent flow generating apparatus for use with a refrigerant containing heat exchange system having a refrigerant carrying line, comprising:

a) a housing fitted into the refrigerant carrying line and b) means within said housing for agitating the refrigerant to produce turbulent motion in the refrigerant, wherein said agitation means comprises:

a first disk comprising:

i) a first perimeter rim with a first central orifice and ii) at least two first blades projecting from said first perimeter rim into said first central orifice and a second disk comprising:

i) a second perimeter rim with a second central orifice and ii) at least two second blades projecting from said second perimeter rim into said second central orifice.

3. A turbulent flow generating apparatus for use with a refrigerant containing heat exchange system having a liquid refrigerant carrying line, comprising:

a) a housing fitted into the liquid refrigerant carrying line, wherein said housing comprises first and second halves in which said first half mates with said second half to generate said housing and b) means within said housing for agitating the refrigerant to produce turbulent motion in said the refrigerant.

4. A turbulent flow generating apparatus according to claim 3, wherein said first housing half comprises first cylindrical member having a first region that expands into a larger diameter second region and said second housing half comprises a second cylindrical member having a first region that tapers into a narrower diameter second region, wherein said first cylindrical member second region fits within said second cylindrical member first region.

5. A turbulent flow generating apparatus according to claim 3, wherein said agitation means comprises at least one blade secured to a disk within said housing, wherein said blade induces rotational motion in the refrigerant as the refrigerant travels past said blade.

6. A turbulent flow generating apparatus according to claim 3, wherein said agitation means comprises a first disk comprising:

a) a first perimeter rim with a first central orifice and b) at least a first blade projecting from said first perimeter rim into said first central orifice.

7. A turbulent flow generating apparatus according to claim 6, further comprising a second disk comprising:

a) a second perimeter rim with a second central orifice and b) at least a second blade projecting from said second perimeter rim into said second central orifice.

8. A turbulent flow generating apparatus for use with a refrigerant containing heat exchange system having a liquid refrigerant carrying line, comprising:

a) a housing fitted into the liquid refrigerant carrying line comprising:

i) a first housing half that comprises first cylindrical member having a first region that expands into a larger diameter second region and ii) a second housing half that comprises a second cylindrical member having a first region that tapers into a narrower diameter second region, wherein said first cylindrical member second region fits within said second cylindrical member first region and b) means within said housing for agitating the refrigerant to produce turbulent motion in the refrigerant, wherein said agitation means comprises a first disk comprising:

i) a first perimeter rim with a first central orifice and ii) at least two first blades projecting from said first perimeter rim into said first central orifice.

9. A turbulent flow generating apparatus according to claim 8, further comprising a second disk comprising:

a) a second perimeter rim with a second central orifice and b) at least two second blades projecting from said second perimeter rim into said second central orifice.

10. A turbulent flow generating apparatus according to claim 9, wherein said first and said second disks fit within said second cylindrical member first region and proximate said first cylindrical member second region, thereby securing said first and said second disks within said housing.

11. A turbulent flow generating apparatus according to claim 10, wherein each said first and said second disks have a plurality of blades, wherein when fitted within said second cylindrical member first region, said plurality of blades are aligned to generate regular spacings between said blades on both said first and said second disks.

12. A method of increasing efficiency of in a refrigerant containing heat exchange system having a refrigerant carrying line, comprising the steps of:

a) placing in the refrigerant carrying line a turbulent flow generating apparatus, wherein said turbulent flow generating apparatus comprises:

i) a housing fitted into the refrigerant carrying line comprising:

A) a first housing half that comprises first cylindrical member having a first region that expands into a larger diameter second region and B) a second housing half that comprises a second cylindrical member having a first region that tapers into a narrower diameter second region, wherein said first cylindrical member second region fits within said second cylindrical member first region and ii) means within said housing for agitating the refrigerant to produce turbulent motion in said the refrigerant, wherein said agitation means comprises:

A) a first disk comprising:

a first perimeter rim with a first central orifice and at least two first blades projecting from said first perimeter rim into said first central orifice and B) a second disk comprising:

a second perimeter rim with a second central orifice and at least two second blades projecting from said second perimeter rim into said second central orifice and b) passing the refrigerant through said turbulent flow generating apparatus.

13. A method of increasing efficiency in a heat exchange system according to claim 12, wherein said first and said second disks fit within said second cylindrical member first region and proximate said first cylindrical member second region, thereby securing said first and said second disks within said housing.

14. A method of increasing efficiency in a heat exchange system according to claim 13, wherein each said first and said second disks have a plurality of blades, wherein when fitted within said second cylindrical member first region, said plurality of blades are aligned to generate regular spacings between said blades on both said first and said second disks.

15. A method of increasing efficiency of a refrigerant containing heat exchange system having a refrigerant carrying line, comprising the steps of:

a) placing in the refrigerant carrying line a plurality of turbulent flow generating apparatus spaced within the refrigerant carrying line to efficiently mix the refrigerant with pooled lubricants and to blend the components comprising the refrigerant, wherein said turbulent flow generating apparatus comprises:

i) a housing fitted into the refrigerant carrying line comprising:

A) a first housing half that comprises a first cylindrical member having a first region that expands into a larger diameter second region and B) a second housing half that comprises a second cylindrical member having a first region that tapers into a narrower diameter second region, wherein said first cylindrical member second region fits within said second cylindrical member first region and ii) means within said housing for agitating the refrigerant to produce turbulent motion in said the refrigerant, wherein said agitation means comprises:

A) a first disk comprising:

a first perimeter rim with a first central orifice and at least two first blades projecting from said first perimeter rim into said first central orifice and B) a second disk comprising:

a second perimeter rim with a second central orifice and at least two second blades projecting from said second perimeter rim into said second central orifice and b) passing the refrigerant through said turbulent flow generating apparatus, thereby mixing the refrigerant with pooled lubricants and blending the components comprising the refrigerant.

16. A method of increasing efficiency in a heat exchange system according to claim 15, wherein said first and said second disks fit within said second cylindrical member first region and proximate said first cylindrical member second region, thereby securing said first and said second disks within said housing.

17. A method of increasing efficiency in a heat exchange system according to claim 16, wherein each said first and said second disks have a plurality of blades, wherein when fitted within said second cylindrical member first region, said plurality of blades are aligned to generate regular spacings between said blades on both said first and said second disks.

* * * * *